United States Patent [19]

Bakay et al.

[11] Patent Number: 4,688,397

[45] Date of Patent: Aug. 25, 1987

[54] MULTI-STAGE HEAT PUMP OF THE COMPRESSOR-TYPE OPERATING WITH A SOLUTION

[75] Inventors: Arpád Bakay; György Bergmann; Géza Hivessy; István Szentgyorgyi, all of Budapest, Hungary

[73] Assignee: Energiagazdalkodasi Intezet, Budapest, Hungary

[21] Appl. No.: 804,294

[22] Filed: Dec. 3, 1985

[30] Foreign Application Priority Data

Dec. 3, 1984 [HU] Hungary ..... 4461/84

[51] Int. Cl.[4] ..... F25B 7/00

[52] U.S. Cl. ..... 62/335; 62/502; 62/510

[58] Field of Search ..... 62/112, 114, 502, 510, 62/335

[56] References Cited

U.S. PATENT DOCUMENTS

| | | | |
|---|---|---|---|
| 2,952,139 | 9/1960 | Kennedy et al. | 62/502 X |
| 3,203,194 | 8/1965 | Fuderer | 62/502 X |
| 4,089,186 | 5/1978 | Rojey et al. | 62/502 X |
| 4,406,135 | 9/1983 | Rojey et al. | 62/114 |

*Primary Examiner*—Lloyd L. King

*Attorney, Agent, or Firm*—Handal & Morofsky

[57] ABSTRACT

A hybrid heat pump wherein the operating medium is a mixture of media which dissolve in each other and have different boiling points. The condensation and/or the evaporation is performed on more than one pressure levels and at variable temperatures. The compressor performs the suction on more than one pressure levels and performs the discharge on more than one pressure level. Between low pressure operating medium ($p_1$, $p_2$) and large pressure operating medium ($p_3$, $p_4$, $p_5$) the heat transfer is performed by the internal heat exchangers.

4 Claims, 16 Drawing Figures

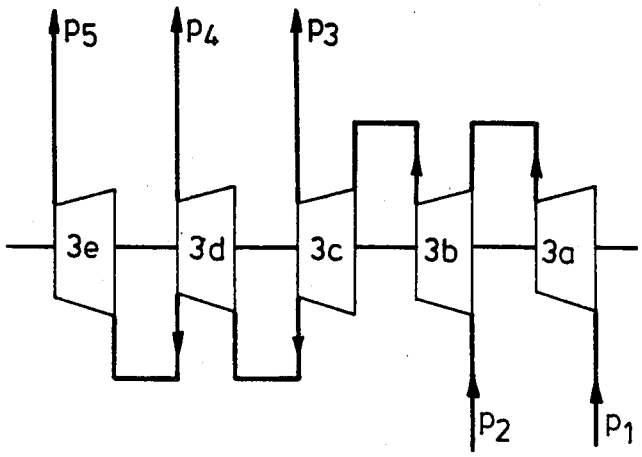
Fig. 11.a
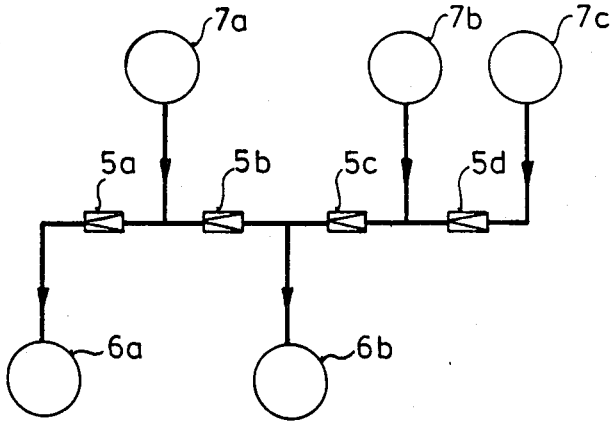
Fig. 11.b

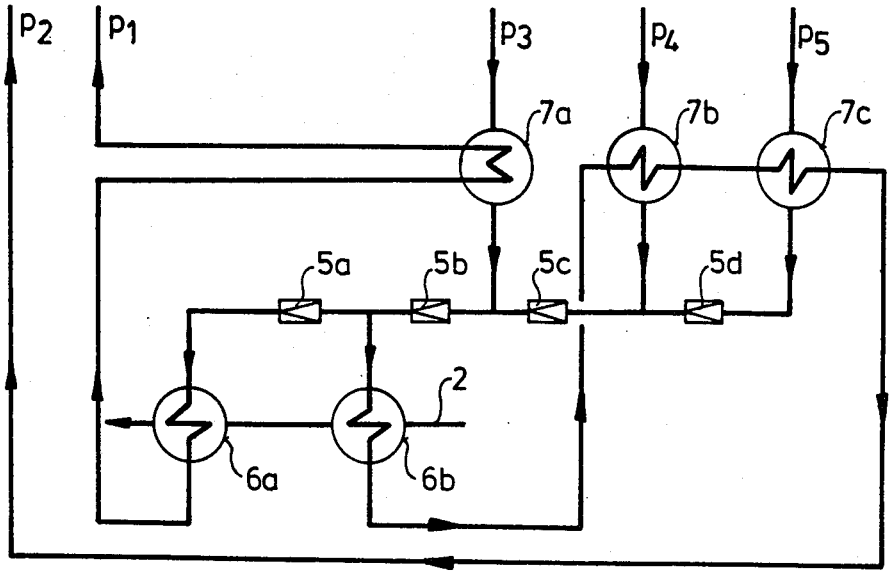
Fig.11.c
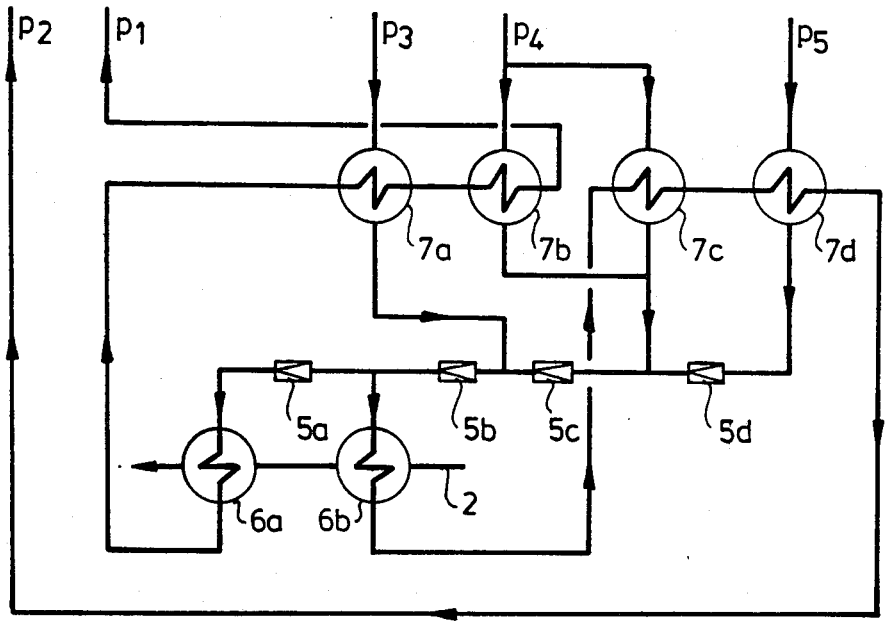
Fig.11.d

MULTI-STAGE HEAT PUMP OF THE COMPRESSOR-TYPE OPERATING WITH A SOLUTION

The object of the invention is such a heat pump which employs as its operating medium a mixture of media which dissolve in each other very well and have different boiling points, and such operating medium is passed through such a vapor compressor which comprises more than one suction ports and/or discharge ports and, its construction is being such, that the vapor compressor is capable of performing the suction simultaneously from different pressure levels and/or capable of performing the compression into different pressure levels.

Possibilities of applications and the improvement of the power factor of heat pumps are constantly looked into worldwide.

The presently used heat pumps attempt to approximate mostly the Carnot-cycle, which combines an isothermic heat removal and heat transfer with two isentropic changes of state.

It is known that between heat reservoirs having a constant temperature, the Carnot-cycle is the most advantageous heat pumping cycle which is theoretically possible. In the technical practice, as far as the heat source is concerned the condition that it should be an infinitely large (that is, which can be considered isothermic) heat reservoir is true only very seldom (for example, for cases of large river or lake, or the air), and as far as the heat users are concerned, such condition is never satisfied. The more favorable situations from the enery standpoint (such as raised heat, thermal wall, etc.(will exclude such possibility even in the case of the heat sources.

Therefore, if one is looking into the possibilities of economical heat pumping, then one should consider that the heat should be removed from a medium which is cooling to a considerable extent and it should be used for the warming of a medium which is capable of undergoing a considerable warming. In such situation it is advantageous to employ a cycle having variable temperature characteristics, since it will result in a most favorable power factor under similar temperature limits, then the Carnot-cycle. This is explained by the fact that in the case of a cycle having variable temperature characteristics and conforming to the heat source and the heat user will require much less energy input, then a cycle characterized by an isothermic heat removal.

BRIEF DESCRIPTION OF THE DRAWINGS

FIGS. 11*a*14 11*d* illustrate the various connection possibilities for multi-stage heat pumps according to the present invention;

Figure 1:
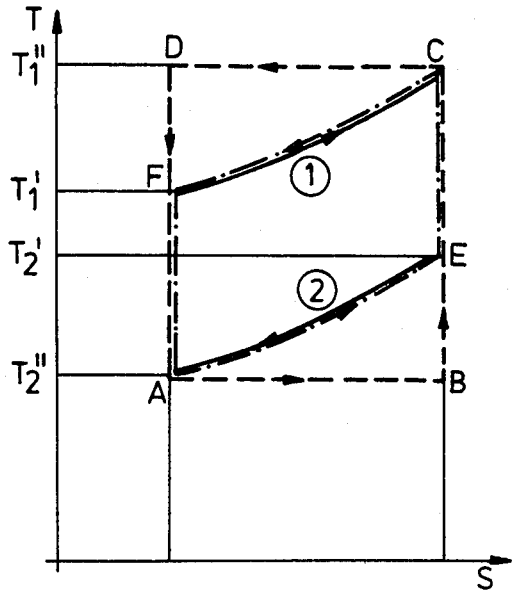
FIG. 1 illustrates the various cycles on a T-s diagram.

For the explanation of the above considerations serves FIGS. 1 which illustrates the cycles on a T-s (temperature-enthropy) diagram.

Let the heat source be medium 2, which can be cooled from temperature $T_2$. The function of the heat pump is to warm up the medium 1 from temperature $T_1$ to $T_2$. The change of state of the two media is illustrated by the solid line.

If such heat pumping operation is to be solved by a single Carnot-cycle, then the most favorable power factor (which could have been obtained only in the case of infinitely large heat sources (can be obtained from cycle ABCD) identified by the dashed line.

On section AB an isothermic heat receiving (evaporation) takes place, while on section BC isentropic compression, on section CT isothermic heat tranfer (condensation), and on section DE isentropic expansion occurs.

It is known from the thermodynamics that the heat flux $Q_2$ received from the heat source within the cycle is characterized by the area under the section AB, the heat given off to the heat user is characterized by the area under the section CD, the inputted mechanical work (P) is characterized by the difference between the two, that is, by the area enclosed by the cycle ($P=\dot{Q}_1-\dot{Q}_2$).

Under these conditions, the power factor ($\epsilon$) of the heat pump which is the ratio of the useful heat and of the input and mechanical work, can be expressed by the following relationship:

$$\epsilon = \frac{\dot{Q}_1}{P} = 1 + \frac{\dot{Q}_2}{P}$$

The power factor can be increased if we can decrease the required mechanical work, that is, the area enclosed by the cycle. This is not possible with any of the Carnot-cycles, since the heat obtained from medium 2 has to be transferred even in the case of infinitely large heat giving surface, from the lowest temperature ($T_2$) thereof to the highest temperature ($T_1$) of the heat receiving medium 1. In the case of finite heat exchanging surfaces the temperature of evaporation is smaller than $T_2$ and the temperature of the condensation is larger than $P_1$, therefore one should overcome a larger heat gradient, that is, the necessary mechanical work will increase. In order to simplify the underlying analysis, in addition to the ideal compression (that is, isentropic) and expansion, for the time being one will assume the presence of infinitely larger heat exchanges.

The theoretically most favorable heat pumping cycle would be the cycle illustrated by the dotted line in FIG. 1, which conforms completely to the temperature characteristic curve of the heat giving and heat receiving media. In this cycle ABDF, on section AE the variable temperature heat acceptance, on section ECD isentropic compression, on section CFD variable temperature heat transfer, on section FAD isentropic expansion takes place.

On section AE of the cycle the operating medium can receive heat from medium 2 only if its temperature is lower than than of the latter, that is, the curve AE will run under the curve of medium 2. On the other hand, if the heat capacity of the two media are similar and the heat exchanging surface is infinite, then the temperature difference necessary for the heat transfer will decrease to an infinitely small amount, that is, the curve AE will conform to the curve of medium 2. Similarly it can be seen that under the above-noted theoretical conditions the section CF of the cycle will conform from above to the curve of medium 1.

Since during the cycle the heat transfer section of the operating medium cannot fall under the curve of medium 1, because it could not deliver heat to it, and the section of heat receiving cannot go above the curve of medium 2 because it could not receive heat therefrom, it can be seen, that the theoretically more advantageous heat pumping cycle appears to be the one which is illustrated by the dotted line and identified as ECF cycle.

It can be readily seen from FIG. 1, that assuming similar temperatures, the cycle AECF having variable temperature characteristics will be associated by a larger quantity of the extracted heat ($Q_2$), then the cycle ABCD, that is, the area under the curve AE is larger than the area under section AB, and furthermore, the area enclosed by the cycle is smaller, that is, the required mechanical input (B) is smaller. From this it will follow and on the basis of the above formula, that the power factor of the cycle ACF is larger than that of the cycle ABCD. This is a logical consequence since it has been only shown that the cycle AECF is theoretically the most favorable cycle.

In the present day practice, in the elements serving for heat transfer (evaporators, condensers) of the conventional heat pumps (compressor or absorption-type), always a single-component medium, the so-called, heating medium is present, from which it follows that the evaporation and the condensation occurs always at a constant temperature, that is, the actual cycle will approximate to some extent the theoretical cycle identified by the dashed line in FIG. 1.

Figure 2:
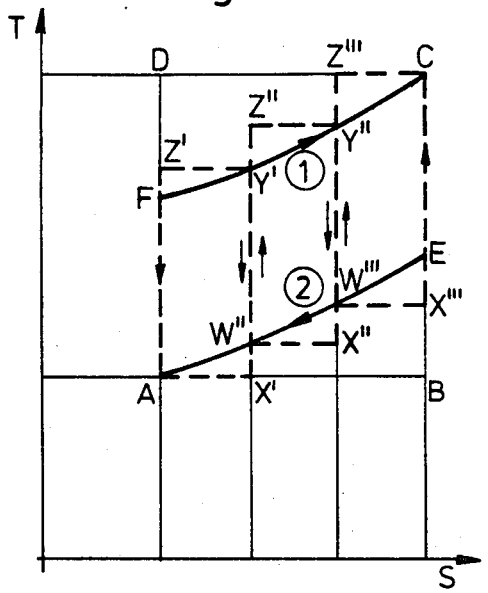
FIG. 2 illustrates the theoretical operating process of a 3-stage heat pump.

Obviously also in the case of such heat pump operating with a single component medium there is a possibility to improve the power factor, to this, however, there is need for several stages. FIG. 2 illustrates the operating process in theory of a 3 stage heat pump shown on a T-s diagram. The cooling of the medium 2 and warming of the medium 1 also here is illustrated by a solid line. It can be seen very well from the Figure that the operating area of the 3 stages illustrated by the dashed line (the joint area of the cycles AX'Y'Z', W''X''Y''Z'' and W'''X''CZ'') is smaller than the area of the cycle ABCD having a single stage and it much closer approximates the theoretically possible most advantageous AECF cycle than the ABCD cycle.

Theoretically a Carnot-cycle having infinitely large number of stages would perfectly approximate the AECF cycle, however, even just a few stages can give excellent results. This is, consequently, an appropriate to improve the power factor. Its disadvantage resides in that in a case of several stages the interconnections of the machine becomes complicated, the number operating elements will considerably increase which on one hand will increase the price of the equipment, on the other hand, will increase the possibility for defect, that is, will reduce the operating reliability.

Due to the above many researchers followed a different path. They tried to construct heat pumps in which the variable temperature characteristics will occur between the heat exchanges. Such can be achieved that for the operating medium in the heat pumping cycle diselect medium (a mixture of amonia and water) which are soluble excellently within each other and have different boiling points.

Figure 3:
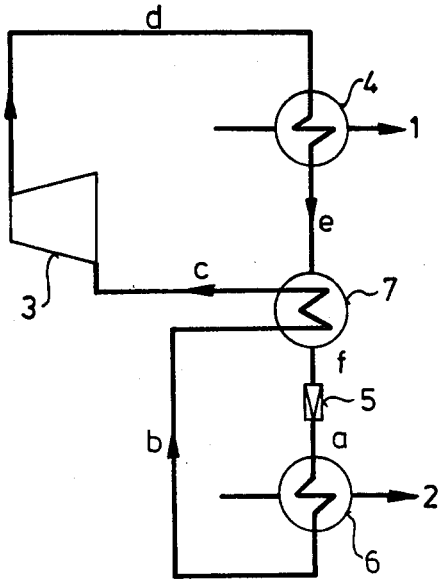
FIG. 3 illustrates the schematic operating connections for a hybrid heat pump.

A heat transfer with variable temperature characteristics in a cycle can be most advantageously accomplished among the presently known processes, by the so-called hybrid heat pump (European Patent No. 0 021 205). Hybrid heat pump (FIG. 3) resembles a conventional heat pump of the compressor type, it differs therefrom however in that in its entire cycle an operating medium flows which consists of 2 components which dissolve very well in each other. In the evaporator (6) which has low pressure the 2 media will not evaporate. As a result, from the evaporator the mixture of a vapor which in the medium having the lower boiling point and of the liquid pool in medium having a lower boiling point will exit and introduce into the compressor (3). The compressor will raise to a higher pressure level the two phase and two component operating medium in the so-called wet compression. From here the vapor and liquid phase will go into a condenser (4) where the vapor rich in the medium having the lower boiling point will condense and will dissolve into the jointly flowing liquid phase in a continuous fashion. The medium through a choke or pressure reduction valve (5) will be returned into evaporator. With the help of an internal heat exchanger (7) one may improve the power factor of the cycle. Such heat exchanger will perform the heat exchanging between the medium exiting from the condenser and the medium exiting the evaporator.

Figure 4:
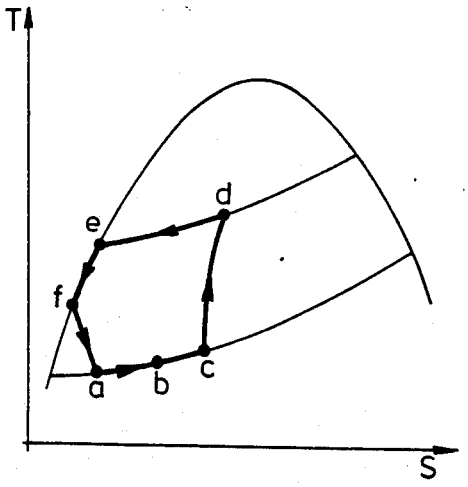
FIG. 4 illustrates the actual cycles for the heat pump of FIG. 3.
Figure 5:
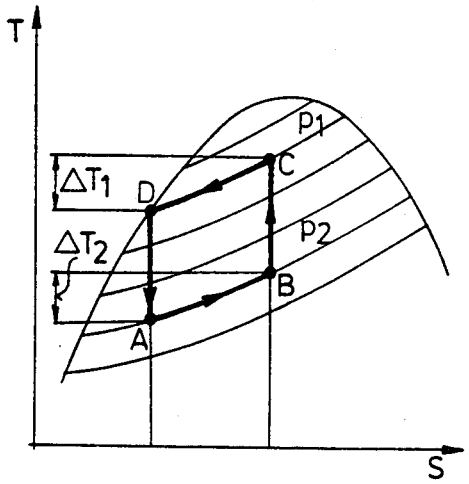
FIG. 5 illustrates the theoretical cycles for the heat pump of FIG. 3.

The actual cycle is illustrated on the T-s diagram of FIG. 4. The letters identifying the individual states correspond to those used in FIG. 3. For sake of simplification, the internal heat exchanger has been omitted and it has been assumed that an isentropic expansion, that is, compression is present. The theoretical cycle of the hybrid heat pump is illustrated in FIG. 5 in the form of a T-s diagram with a operating medium having a predetermined concentration, and which consists of a heat receiving section having variable temperature characteristics (evaporation) and steaming out at constant $P_2$ pressure on the section AD, a isentropic compression (section AC), heat transfer section at variable temperature characteristics (condensation and dissolving occurs at constant $p_1$ pressure on section CD) an isentropic expansion (section DA).

The temperature change of the operating medium in the evaporator (section AB) is $\Delta T_2$, and in the condenser (section CD) is $\Delta T_1$. These two values are substantially equal. This is explained by the characteristics of dual media according to which on the T-s diagram of a medium having a predetermined concentration (FIG. 5) the curves having constant pressure lie approximately parallel.

It is known that even in the case of infinitely large heat exchanging surfaces the heat pumping cycle can conform to the temperature characteristic curve of the heat giving medium only if the heat capacity of the operating medium and of the heat giving medium are similar, that is, during the transfer of a given quantity of heat their temperature will change to a similar extent. The same holds true also for the heat receiving medium. Consequently, if the temperature changes of the heat giving and heat receiving media will substantially differ from each other, than in the heat exchanger of the hybrid heat pump the temperature process of the operating medium cannot simultaneously adjust to both media. It follows that the hybrid heat pump will operate really at an advantageous power factor only if the temperature changes of heat giving and heat receiving media are closely equal and to this will adjust the temperature change of the operating medium in the evaporator and in the condenser.

Figure 6:
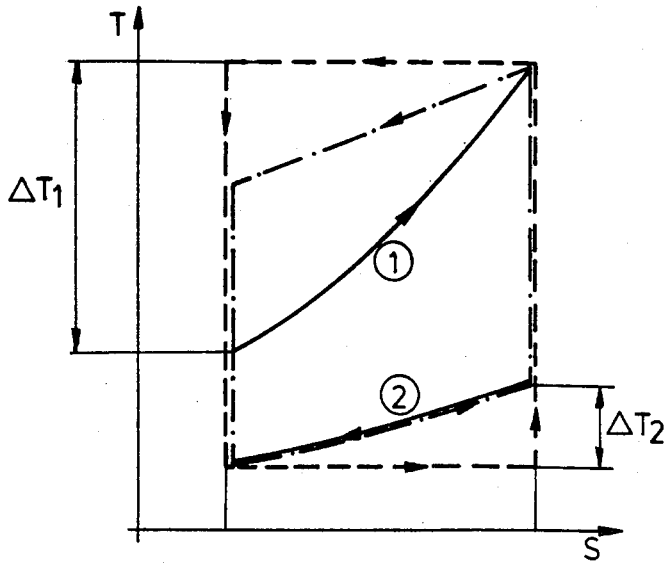
FIG. 6 illustrates on a T-s diagram operating conditions when the temperature change of the heat source is smaller than that of the heat receiver.

If such conditions are not present, then the hybrid heat pump will have lesser advantage than a conventional heat pump. This phenomenon is illustrated on the T-s diagram of FIG. 6. It illustrates a situation wherein the temperature change ( $\Delta T_2$) of the heat giving medium 2 is much smaller than that of the heat receiving medium 1 ( $\Delta T_1$).

A similar situation may occur if the heat source is a waste heat having low heat content, for example a waste water at 30° C., or a warmed up cooling water which can be cooled to plus 5° C. in order to avoid the danger of freezing over, that is, the temperature change will be 25° C. The requirement is to produce from the available tap water at 15° C. a warm water at 85° C. usable in the food producing industry. In this case the temperature changes 70° C., that is, several times over the first value.

In the Figure the temperature characteristics of the media 1 and 2 are illustrated by a solid line. The Figure illustrates ideal cycles (isentropic compression and expansion, infinitely large heat exchanging area). The Carnot-cycle is illustrated by a dashed line and the theoretical cycle of the hybrid heat pump is illustrated by a dotted line which conforms to medium 2. It is well illustrated in the Figure that the area enclosed by the cycle having a variable temperature characteristic and consequently the necessary mechanical input is much smaller than in the case of the Carnot-cycle, it is, however, considerably larger than the minimum work input figured theoretically. The situation will not change even if the cycle is conformed to medium 1 or a intermediate variation is used.

Figure 7:
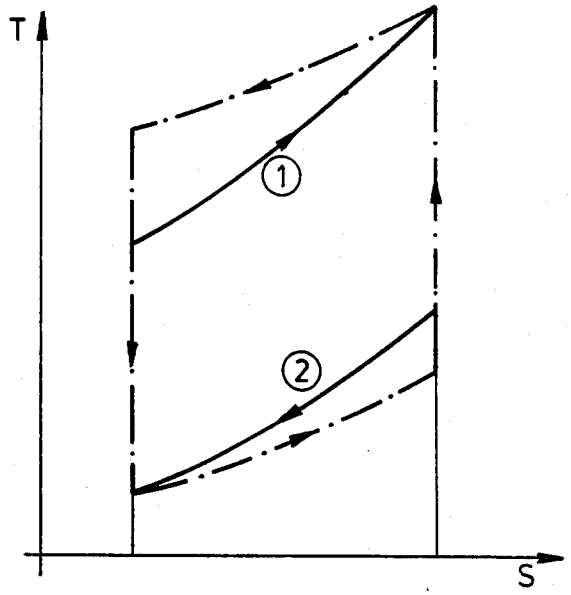
FIG. 7 illustrates on a T-s diagram operating conditions when the temperature change of the heat source is closely similar to that of the heat receiver.

It is also a problem if the temperature change of the heat giving and heat saving medium is closely similar, however, they are considerably larger than those which could be approximated by an operating medium having two components. Such situation is illustrated on the T-s diagram of FIG. 7, wherein the heat giving and heat saving media illustrated by a solid line, the cycle is illustrated by a dotted line. It can be seen that the input of the cycle is considerably larger than the theoretical work input, although here it is also much more favorable than in the case of the Carnot-cycle not illustrated on the Figure. The temperature change can be influenced by changing the concentration, the pressure and the vapor content at the output end of the evaporator, however, even the influence of such factors may solve the problems only within limits.

Our invention is concerned with further improvements to the hybrid heat pump in such a manner, that the temperature characteristics of the evaporator and of the condenser can be adjusted or conformed within wide limits and independently from each other to the temperature characteristics of the heat giving and heat receiving medium, whereby the theoretically largest possible power factor can be very closely approximated.

Figure 8:
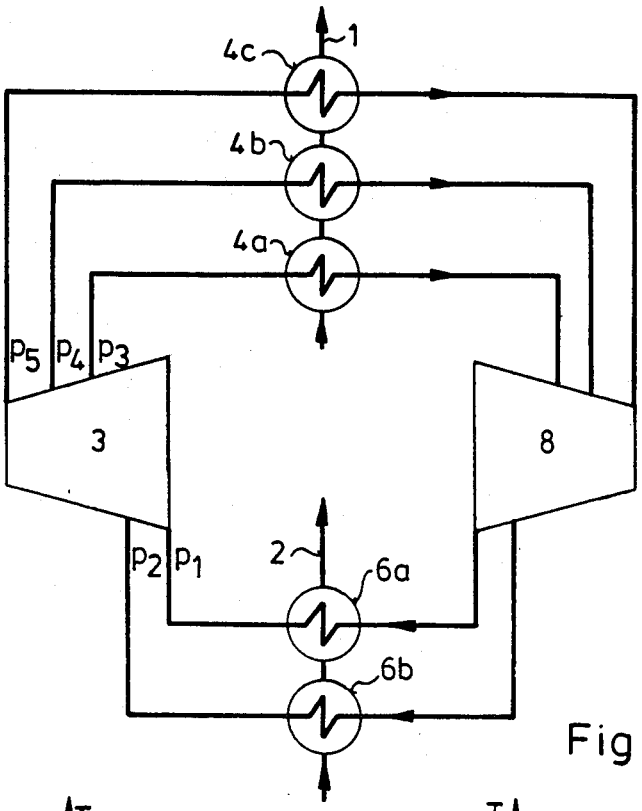
FIG. 8 illustrates a heat pump with components operating at more than one pressure level according to the present invention.

The heat pump according to the present invention operates with an operating medium having two components, and which evaporates at variable temperature and condensates, and wherein at least one of the evaporators and the condensers operates at pressure levels which are more than one, therefore, the temperature change of the operating medium can be adjusted to necessity. An exemplary interconnection of such theoretical cycle is illustrated in FIG. 8. The operating medium leaves the compressor 3 through three different pressure levels, therefore, medium 1 will be warmed by a condenser which has three different pressure levels (4*a*, 4*b*, 4*c*). From here the operating medium enters an expansion turbine 8 on three different pressure levels, and from which it leaves on two pressure levels into two evaporators (6*a* and 6*b*), which are being warmed by the heat giving medium 2.

Figure 9:
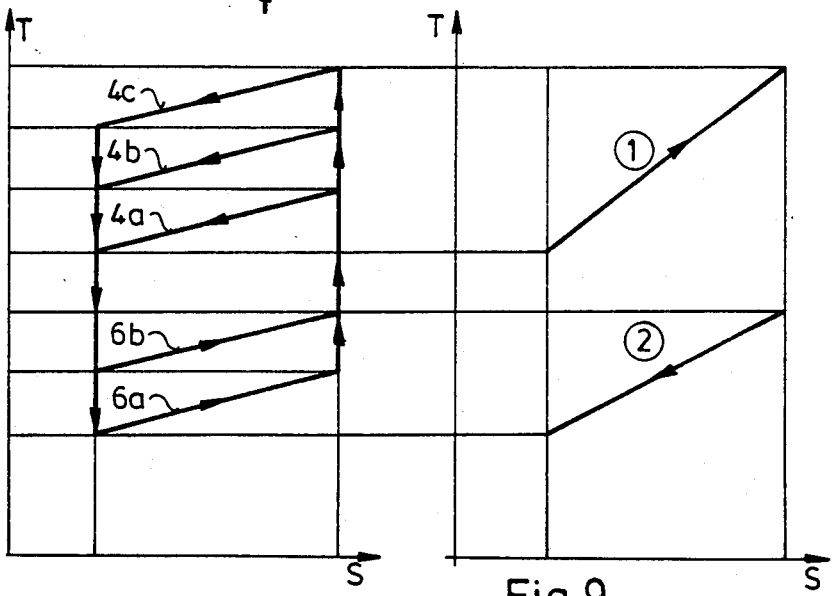
FIG. 9 illustrates a T-s diagram for the pump of FIG. 8.

FIG. 9 illustrates the cycle on a T-s diagram in the case of isentropic expansion. The temperature changes of media 1 and 2 are illustrated on the right side of the Figure individually in the case of infinite heat exchanging surface. The three stages of the condenser and the two stages of the evaporator are only for illustrative purposes on FIGS. 8 and 9, their number can be changed according to necessity.

Figure 10:
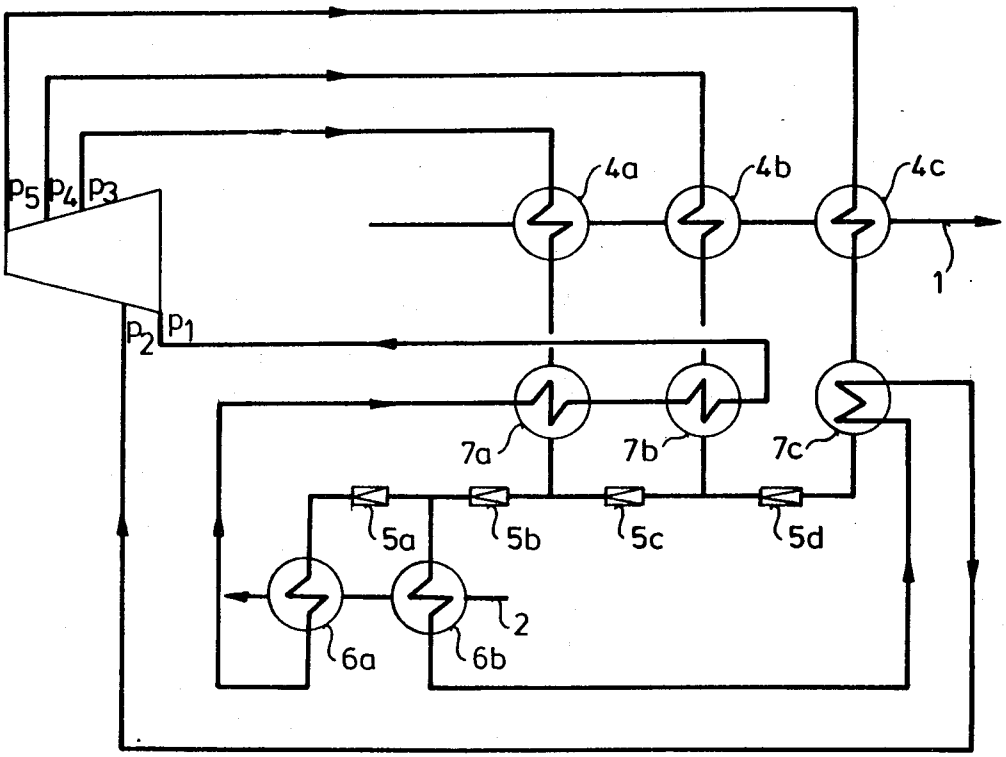
FIG. 10 illustrates a multi-stage heat pump with pressure reducers.

The actual interconnection of the heat pump is much more complicated, it contains internal heat exchangers, the use of an expansion turbine can be considered economical only in the case of very large machines, therefore, generally pressure reducers (such as choke or reduction valves)are used instead. Such variant is shown in FIG. 10. In it, similarly to the previous example, the condenser has three stages, the evaporator has 2 stages, again such numbers can be changed.

From compressor 3 the operating medium leaves on three different pressure levels ($p_3$, $p_4$, $p_5$) into condenser 4*a*, 4*b*, 4*c*, where it will warm up the heat receiving medium 1. After the condensers the internal heat exchanges 7*a*, 7*b*, 7*c* are following, here the high pressure operating medium will cool further and delivers heat to the low pressure operating medium. The expansion valves 5*a*, 5*b*, 5*c*. 5*d* will reduce the pressure of the operating medium to the necessary level, thereafter the operating medium will enter onto pressure levels the evaporators 6*a*, 6*b*.

The evaporators are warmed by the medium 2 which gives off the heat. The operating medium which has been warmed up and partly evaporated here will not undergo to further warming in the internal heat exchanges 7*a*, 7*b*, 7*c* and thereafter it will enter at appropriate pressure levels ($p_1$ and $p_2$) the compressor 3.

If the structure of the compressor is not adapted to have suction and pressure ports on various pressure levels, the problem can be solved by several compressors as shown in FIG. 11*a*. Here 5 compressors are shown (3*a*, 3*b*, 3*c*, 3*d*, 3*e*)preferably on a common shaft, however, such is not an absolute requirement. It can sometimes happen that the suction pressure $p_2$ is somewhat larger than the discharge pressure $p_3$. This as seen in FIG. 11*a* will mean only a change that the operating medium will be discharged by compressor 3*b* at a pressure of $p_3$ and the medium having a pressure of $p_2$ will enter the compressor 3c. If this unusual situation occurs, then the group of the expansion valves must be rearranged according to the showing of FIG. 11b.

If the structure of the expansion turbine illustrated in FIG. 8 is not adapted to have input and output ports on several pressure levels, then the same solution should be used as it has been proposed in connection with the compressor on FIG. 11a.

The connection of the internal heat exchanges (11a, 11b, 11c) in FIG. 10 is such that the operating medium leaving the evaporator at pressure $p_2$ will be warmed up by the liquid having a pressure $p_5$, while the medium having a pressure of $p_5$, while the medium having a pressure of $p_1$ will be warmed by the liquid having pressures of $p_3$ and $p_4$. The connection shown in the Figure under certain values of the media flux and pressures is optimum, however, such situation may occur (between the individual condensers and evaporators the immediate flux, the pressure levels and the associated temperature developments will be distributed differently), wherein a connection differing from that shown in the Figure may lead to thermodynamic advantages.

As an example we will illustrate in FIG. 11c such situation, wherein the medium having a pressure of $p_1$ and leaving the evaporator 6a will be warmed by liquid pressure $p_3$ in the internal heat exchange 7a, while the medium having a pressure of $p_2$ will be warmed in the internal heat exchanges 7b and 7c by the medium having a pressure of $p_4$ and $p_5$. It can also happen that the heat given off by the condensate at a pressure $p_4$ should be divided between the media having pressures $p_1$ and $p_2$, as can be seen in FIG. 11d. Is is noted that on the Figure the medium having the pressure of $p_3$ is divided between the heat exchanges 7b and 7c which deliver the heat from it and they are, therefore, connected parallel, there are, however, such situation, where the internal heat exchanges 7b and 7c are preferred to be collected in a series along the flow of the medium having the pressure of $p_3$.

Figure 12:
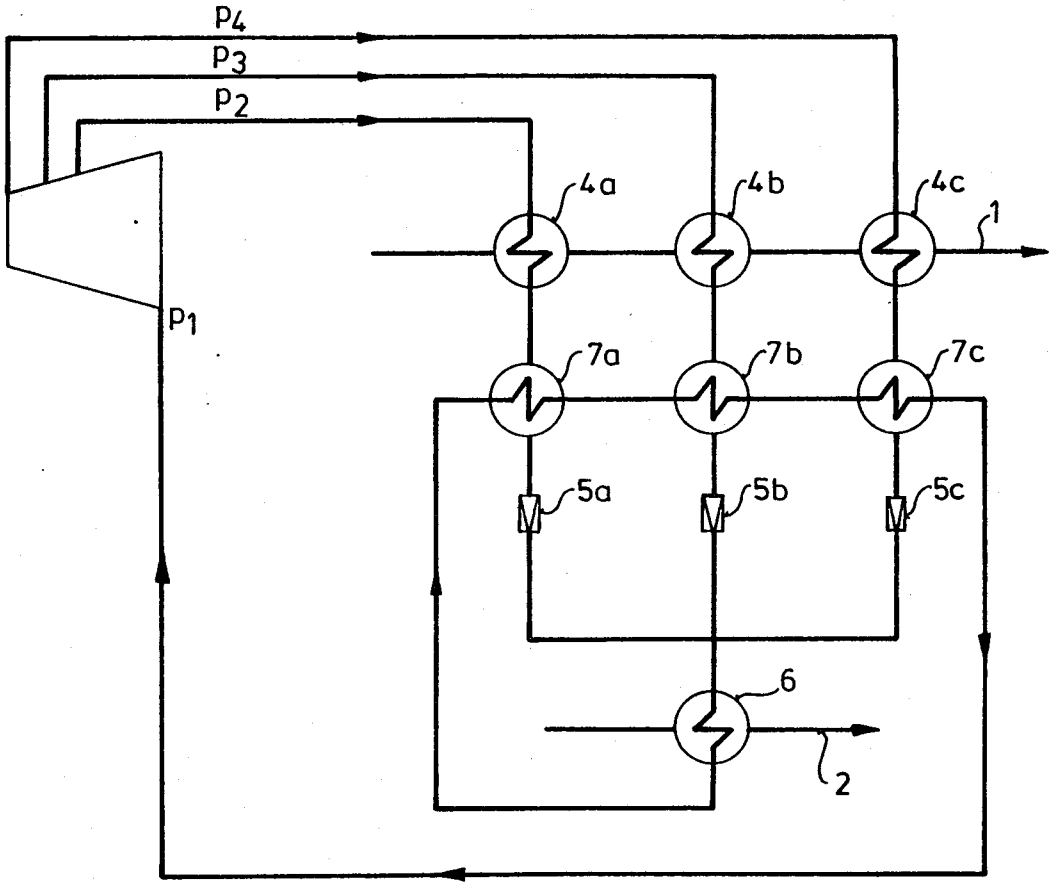
FIG. 12 illustrates an embodiment in which only the condenser is divided into three pressure levels.
Figure 13:
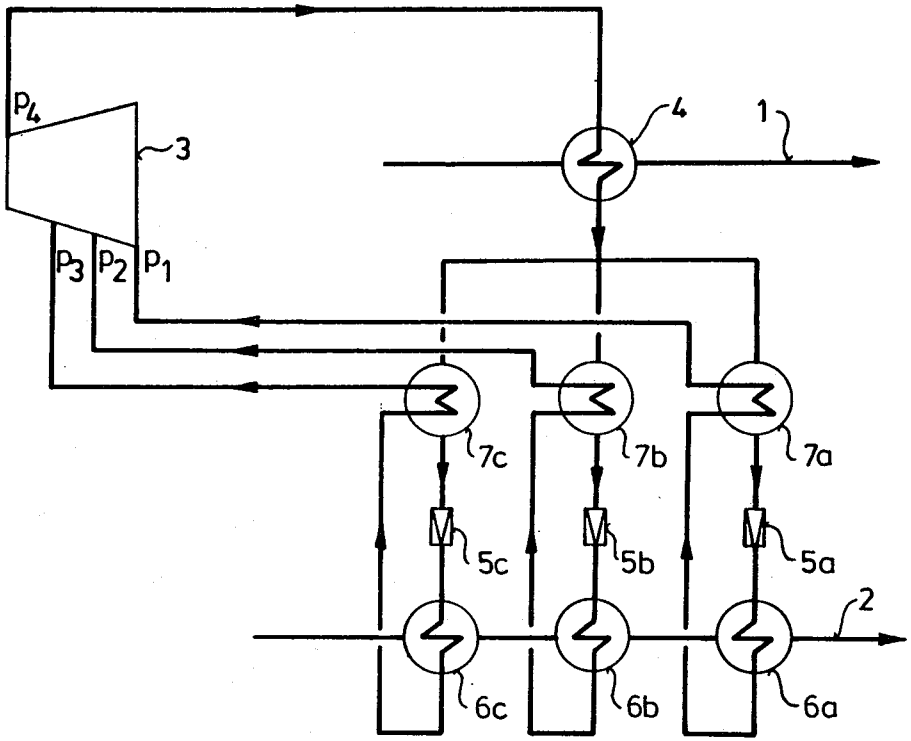
FIG. 13 illustrates an embodiment operating under conditions opposite to that of FIG. 12.

As a special embodiment for the solution of the inventive principle is illustrated on FIG. 12, wherein only the condenser is divided into three pressure levels, therefore, the compressor will perform the suction only on a single level and deliver its discharge on three pressure levels. This is necessary in the case when the temperature change of the medium receiving the heat is considerably larger than that of the heat giving medium. Its inverse case is illustrated in FIG. 13.

FIG. 10 illustrates a general solution of the invention, wherein the condensers and the evaporators have different number of stages. In special cases such number of stages can be equal, for example, to suction pressure stages at the compressor (that is, two evaporator stages) and two discharge pressure stages in the compressor, that is, two condensor stages).

If in such special situation the media flow is divided between the various stages in such a manner than the media flow of the condenser having the larger pressure is equal to that of the higher pressure evaporator, and the media flow of the condenser having the smaller pressure is equal to that of the smaller pressure evaporator, then the solution according to the inventive principle can be subdivided into two mutually independent hybrid heat pump cycles connected in series.

The same inventive principle holds also when the number of stages of the evaporator and of the condenser are equal, but larger than 2 (for example 3).

It is noted that the description of the invention is concerned throughtout with a heat pump. It is, however, well known that a refrigeration apparatus will differ from a heat pump only in that the removed heat is the one which is considered useful and not the given off heat. All the above which has been described in connection with heat pumping, applies in principle also to refrigerator apparatus.

We claim:

1. A heat pump comprising at least one compressor, evaporator, condenser, and pressure reducing element, conduits for interconnecting said compressor, evaporator, condenser and pressure reducing element, an operating medium consisting of a mixture of two media dissolving very well in each other and having different boiling points for effecting the condensation and the evaporation to occur at variable temperatures, said compressor (3) having at least two suction and discharge ports for simultaneously performing the suction from more than one different pressure levels and for discharging through more than one different pressure levels, said evaporator (6) having stages, said stages corresponding in number to the stages of the suction side of said compressor, the stages of the condenser (4) corresponding in number to the stages of the discharge side of said compressor.

2. The heat pump according to claim 1, characterized in that between two adjacent pressure levels of the compressor (3) one pressure reducing element (5) is placed.

3. The heat pump according to claim 1, characterized in that for the reduction of the pressure of the operating medium an expansion turbine (8) is provided which comprises a plurality of input and output ports and is adapted to receive simultaneously the operating medium at more than one pressure level and is able to deliver simultaneously the operating medium at more than one pressure level in accordance with said pressure levels of the compressor.

4. The heat pump according to claim 1, characterized in that for the heat transfer between the media leaving the condenser and the evaporator internal heat exchangers are provided.

* * * * *